US007182327B1

(12) United States Patent
Ferrara

(10) Patent No.: US 7,182,327 B1
(45) Date of Patent: Feb. 27, 2007

(54) SEGMENTABLE RESILIENT VISE JAW

(75) Inventor: William Ferrara, Sunrise, FL (US)

(73) Assignee: Vise Jaws Inc., Dearfield Beach, FL (US)

( * ) Notice: Subject to any disclaimer, the term of this patent is extended or adjusted under 35 U.S.C. 154(b) by 0 days.

(21) Appl. No.: 11/474,845

(22) Filed: Jun. 26, 2006

(51) Int. Cl.
*B25B 1/24* (2006.01)

(52) U.S. Cl. ..... 269/224; 269/282; 269/283

(58) Field of Classification Search ..... 269/271–284, 269/224
See application file for complete search history.

(56) References Cited

U.S. PATENT DOCUMENTS

| | | | | |
|---|---|---|---|---|
| 1,372,726 | A | 3/1921 | Sloan | |
| 1,454,148 | A | 5/1923 | Bisset | |
| 3,020,041 | A * | 2/1962 | Peterson et al. | 269/135 |
| 4,216,950 | A | 8/1980 | Mason | |
| 4,221,391 | A | 9/1980 | Dutton | |
| 4,573,669 | A | 3/1986 | Gerry | |
| 4,969,637 | A | 11/1990 | Nishimura | |
| 5,150,888 | A | 9/1992 | Durfee | |
| 5,163,664 | A | 11/1992 | Calaio | |
| 5,649,694 | A | 7/1997 | Buck | |
| 5,893,551 | A | 4/1999 | Cousins | |
| 6,446,952 | B1 | 9/2002 | Sheehy | |
| 6,957,809 | B1 | 10/2005 | Ferrara | |

* cited by examiner

*Primary Examiner*—Robert C. Watson
(74) *Attorney, Agent, or Firm*—Alvin S. Blum

(57) ABSTRACT

An elongate vise jaw plate assembly for mounting on a movable member of a vise is constructed to clamp many individual work pieces for machining. It enables clamping many pieces together in the vise even if their dimensions are not precise. It includes a base portion that is secured to a movable member of the vise. A work piece engaging portion is connected to the base portion by an elastic connector portion. The elastic connector and work piece engaging portions are slit into multiple segments, one for each work piece. Another work piece engaging portion is attached to a stationary member of the vise. Both work piece engaging members are machined to cooperate with work pieces. The work pieces are clamped between the two work piece engaging portions. Differences in the dimensions of the individual pieces are compensated for by the flexing of the connecting portions so that all the pieces are clamped securely for machining.

20 Claims, 12 Drawing Sheets

SEGMENTABLE RESILIENT VISE JAW

TECHNICAL FIELD OF THE INVENTION

This invention relates to work holding devices, and more particularly to readily replaceable machinable plates to be attached to vises.

BACKGROUND OF THE INVENTION

When machining a work piece on a machine tool, the piece must be securely mounted in a vise on the machine so that the machining forces do not move the piece and destroy precision. It is often desirable to machine one or both vise jaw faces in order to secure the piece. U.S. Pat. No. 6,957,809 issued Oct. 25, 2005 to the applicant discloses a jaw plate assembly that is mounted on the vise jaw. It includes a reusable first component that is bolted to a jaw of the vise. It has a recess for cooperating with a dovetail. A second component that is to be custom machined to hold the work piece is inexpensive and disposable. It includes a dovetail for easy securing to the first component. It may be formed in aluminum by extrusion for economy.

When repeatedly machining a plurality of small pieces mounted on the vise at one time, one may find that the dimensions vary enough between pieces that some will not be held tightly enough for machining because others hold the jaws apart. It would be useful to provide a jaw assembly for vises that would allow use of an inexpensive, easily machined, plate for the jaw that could be replaced with minimum cost and effort that would allow secure holding of a plurality of pieces at one time despite minor dimensional variations.

SUMMARY OF THE INVENTION

It is accordingly an object of the invention to provide a jaw assembly for vises that would allow use of an inexpensive, easily machined, plate for the jaw that could be replaced with minimum cost and effort that would allow securely holding a plurality of pieces despite minor dimensional variations. The assembly of the invention comprises a first reusable component that is readily mounted on, and removed from, a machine vise. A second component is made from an easily machined material that can be economically formed by extrusion. The second component is securely connected to the first component by an undercut joint such as a dovetail, or other secure connection joint. The second component has the male element of the joint and the first component cooperates with the male element. The joint holds the two components together when the joint is then tightened by threaded elements. The second component has at least one machinable face portion disposed along the length of the component for engaging the work piece. The face portion is connected to a base portion that includes the male element by a resilient member portion. The second component is constructed from a uniform cross section stock. It may thereby be produced in one piece by extrusion for economy of production, if desired. When multiple work pieces are to be mounted on the vise at one time, the resilient member portion and the machinable face portion may be cut into segments. Each segment is dimensioned to hold a single work piece. When the pieces are held in the vise, it may be that one or more of the pieces have a larger dimension than the others. When the jaws are closed, the larger pieces will hold the jaws too far apart to hold the smaller pieces securely. The operator will then close the jaws tighter. The segments holding the larger pieces will then elastically deform at the resilient member portion, thereby moving the face portion contacting the piece far enough inward so that the smallest piece can be securely held by its segment. The resilient member portion is so constructed that its deformation is elastic. It will return to its original position when the vise is opened to receive another piece for machining. This apparatus enables a user to repeatedly mount a plurality of pieces in a vise and clamp them tightly enough for machining, even when there are slightly different dimensions in the pieces. When machining many small parts in production without this segmentable resilient feature, some parts will often move slightly because they are not held securely. These parts may have to be scrapped. The pieces may require more dimension checking before and/or after machining. These costly measures may be reduced by the invention.

In another embodiment of the invention, the second component is removably affixed directly to a vise component.

Another application for the invention without segmenting applies when two opposed faces of large pieces that are to be held by the vice are not dimensionally reproducible. This may occur, for example, when rectangular pieces are to be clamped, and the faces are not perfectly parallel.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not limitation.

Figure 1:
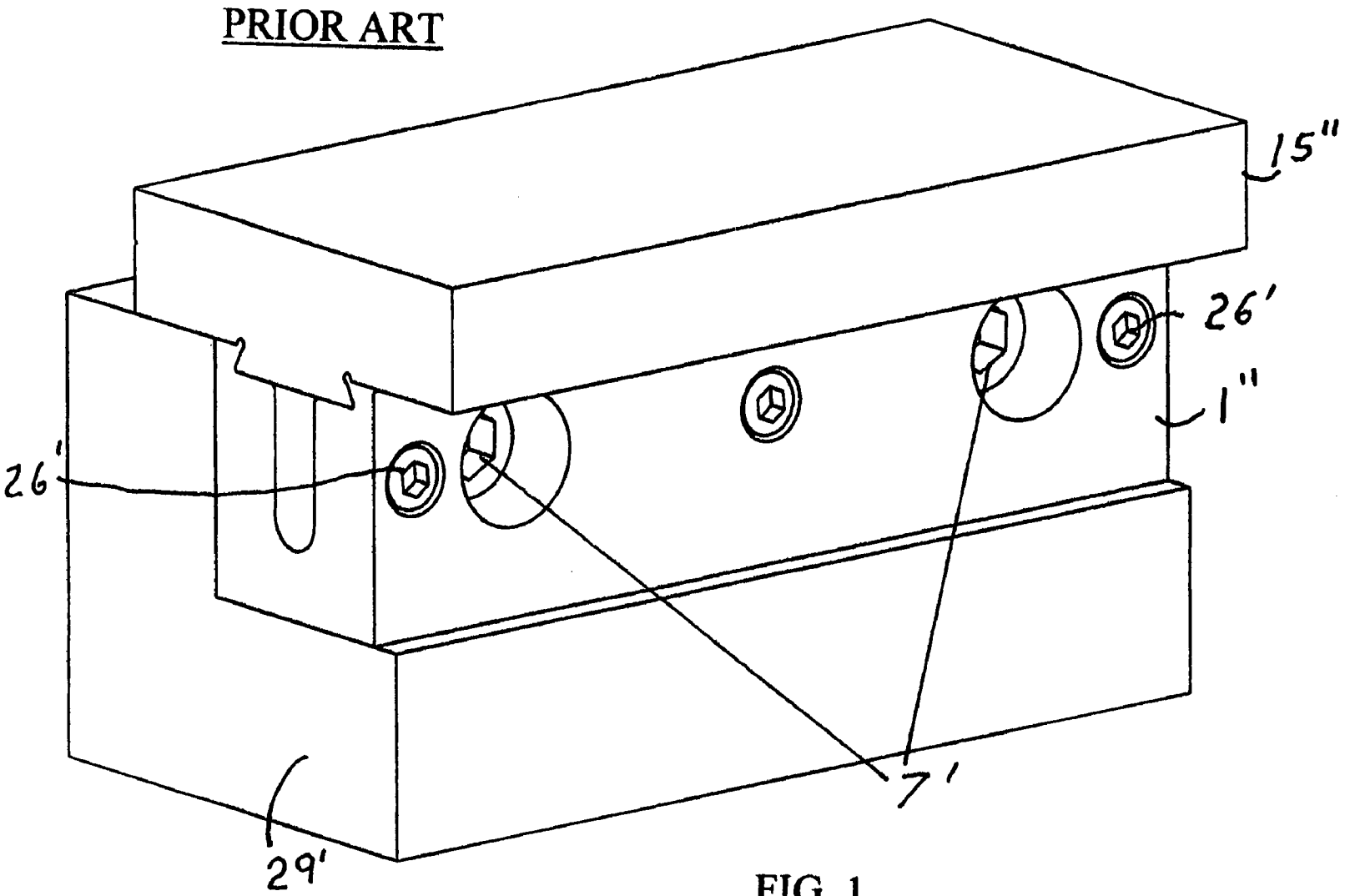
PRIOR ART FIG. 1
FIG. 1 is a perspective view of an assembly of the prior art.
Figure 2:
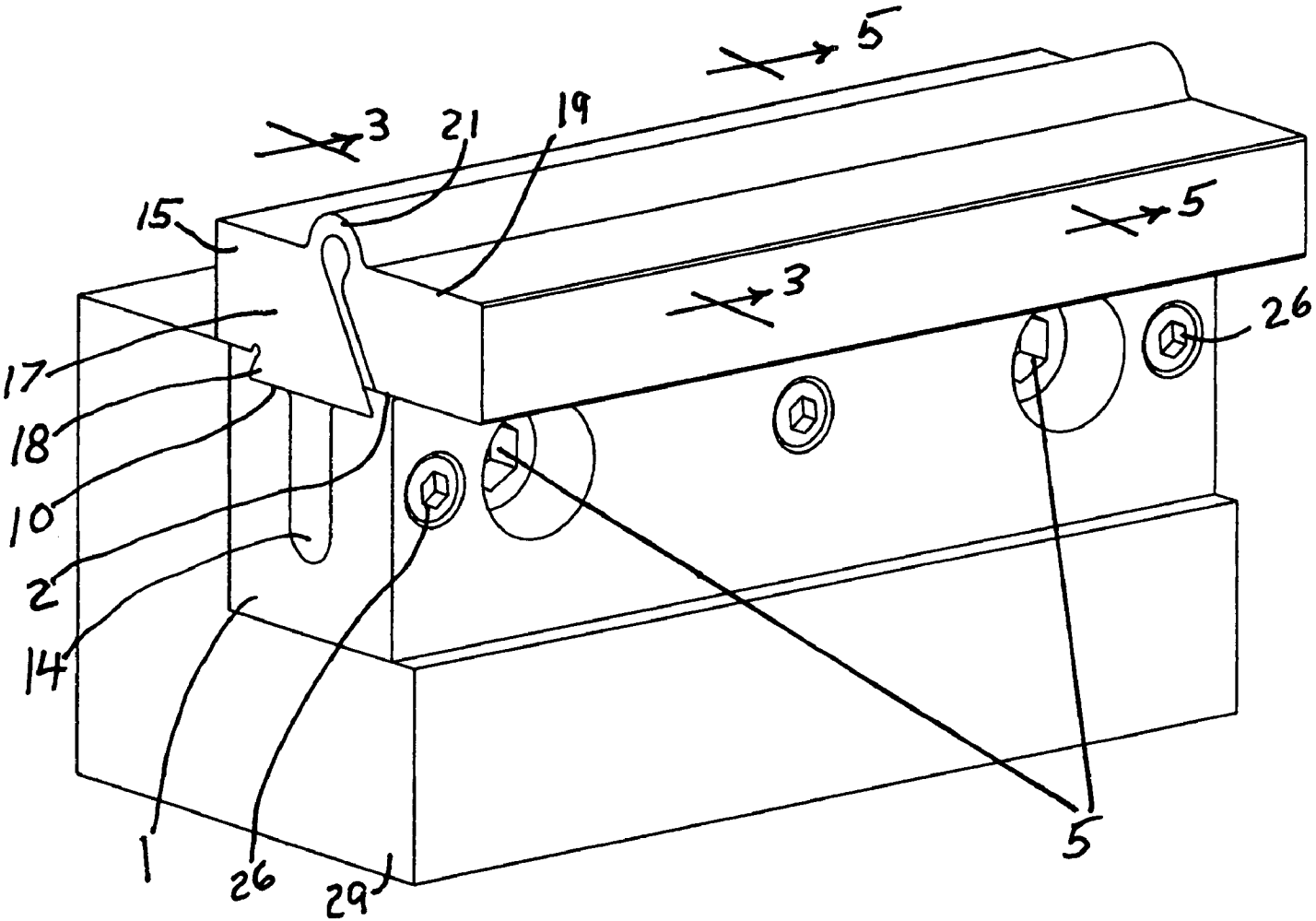
FIG. 2 is a perspective view of the assembly of the invention.
Figure 3:
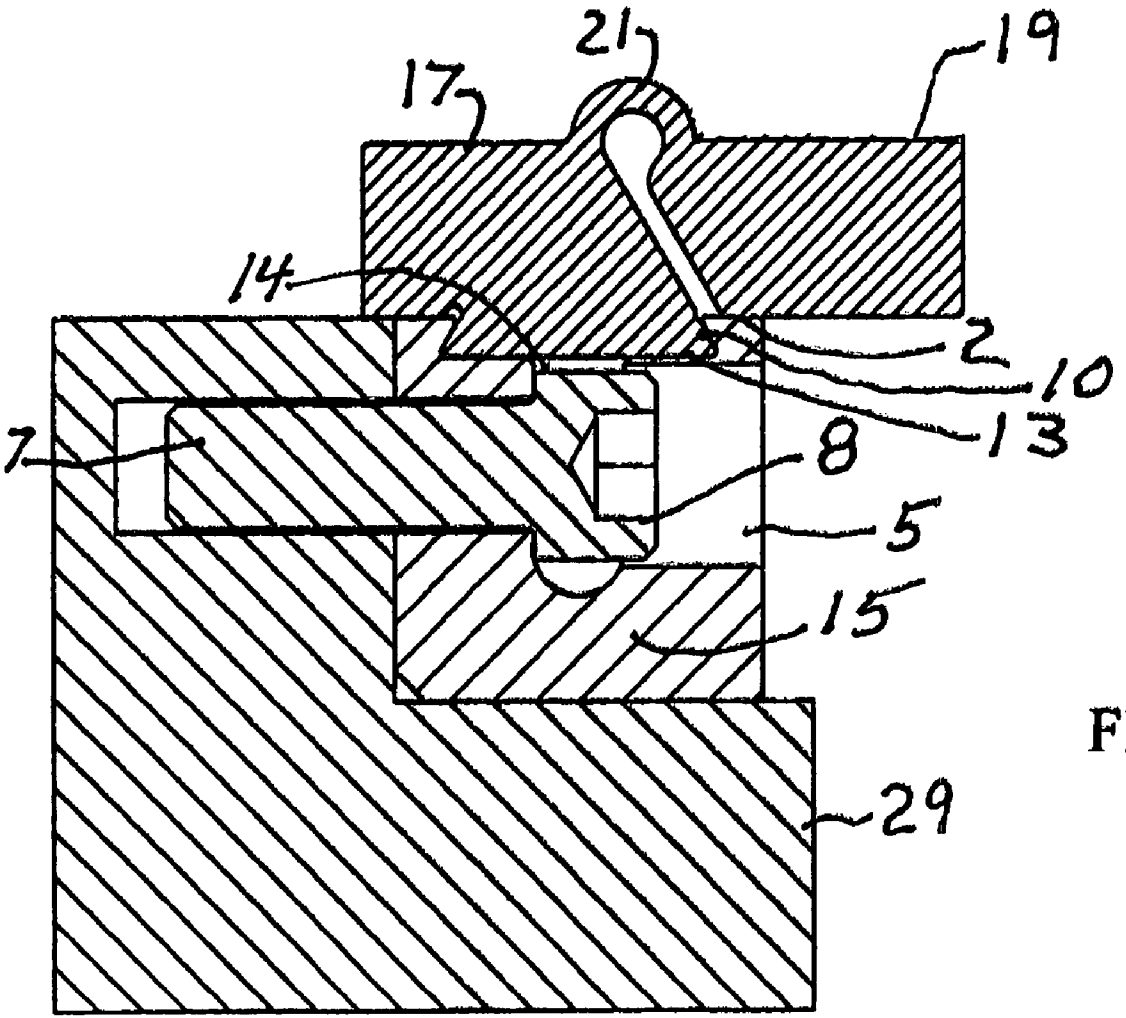
FIG. 3 is a sectional view through line 3—3 of FIG. 2.
Figure 4:
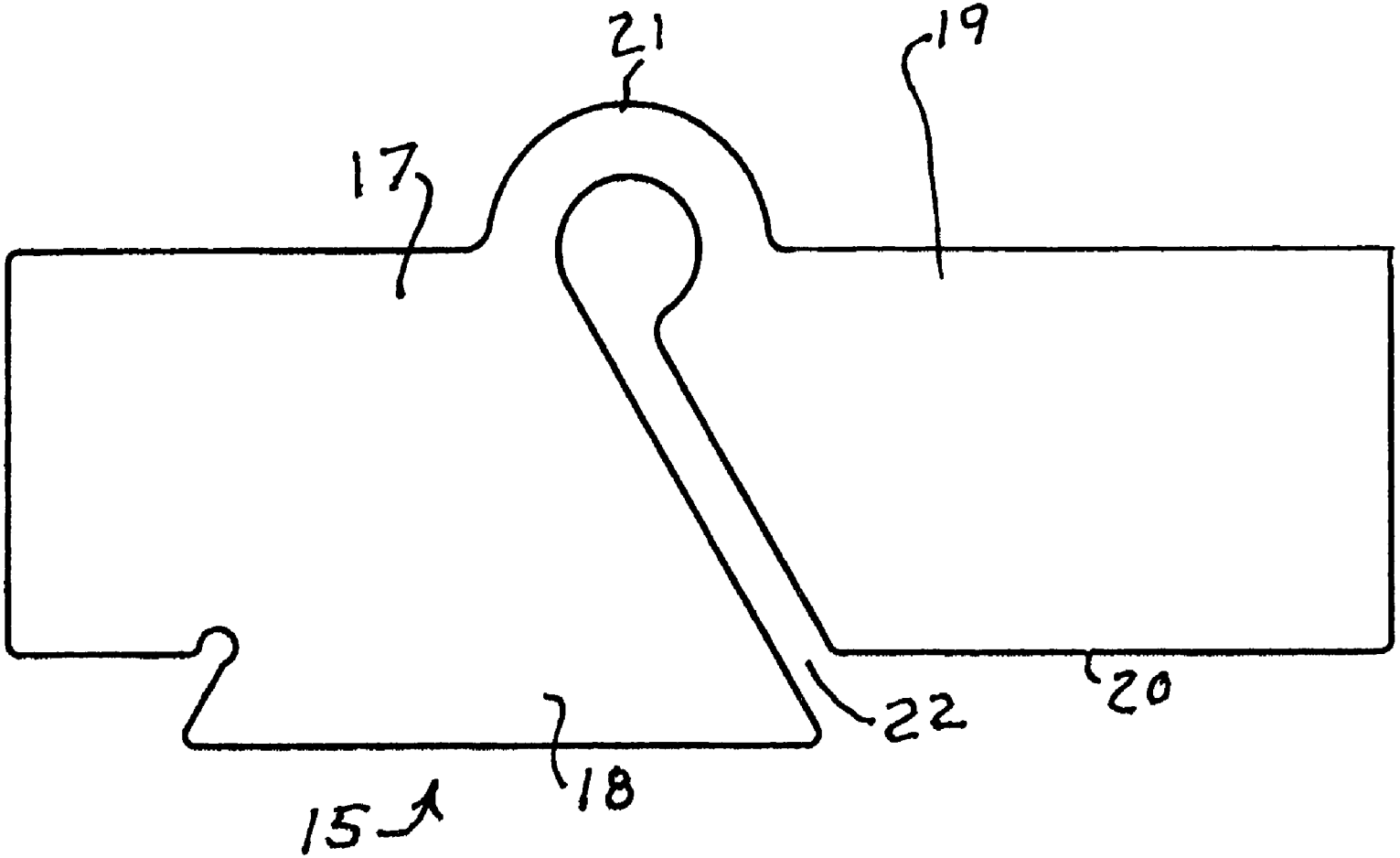
FIG. 4 is a side view of the second component of FIG. 2.
Figure 5:
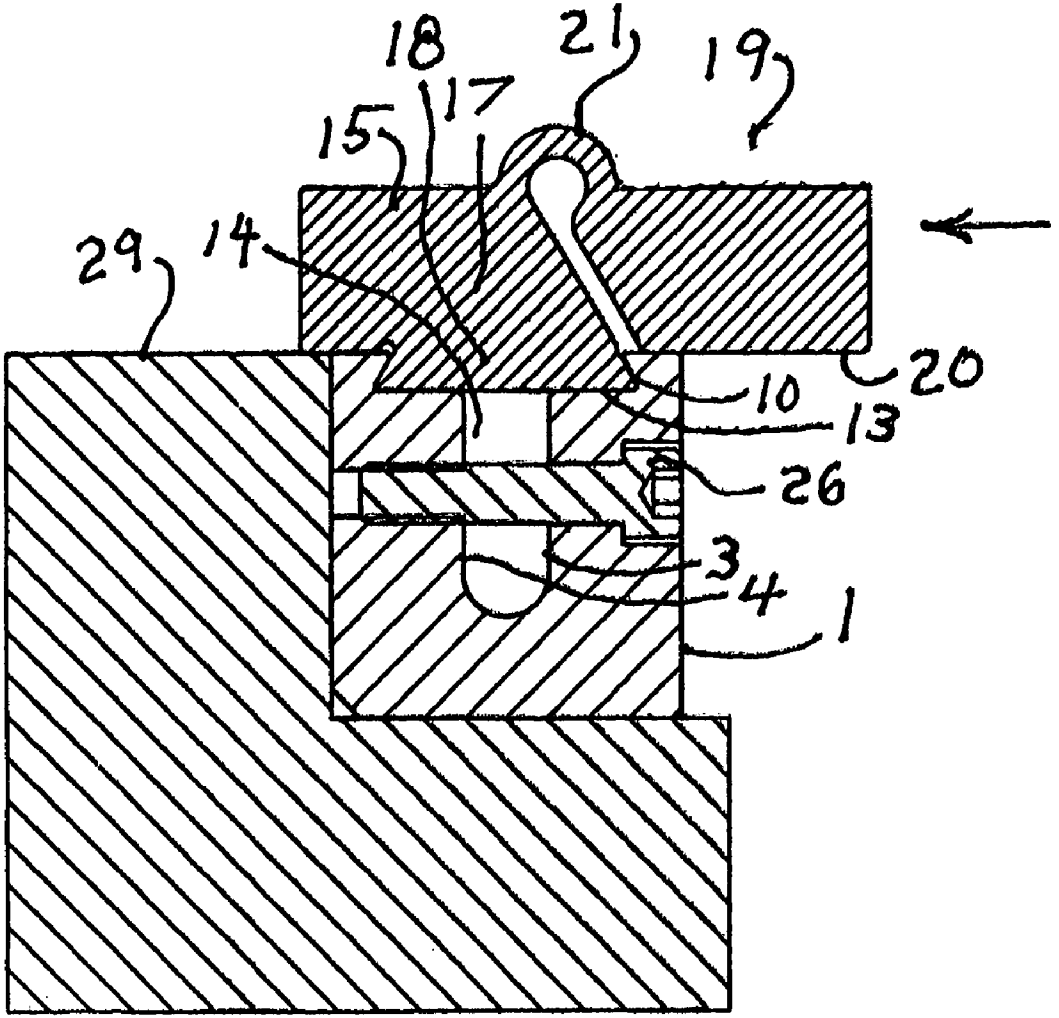
FIG. 5 is a sectional view through line 5—5 of FIG. 2.

Referring now first to FIG. 1, a dovetail vise jaw plate assembly of the prior art described in U.S. Pat. No. 6,957,809 issued to the applicant discloses a first reusable component 1" that bolts 7' secure to the face of a machine vise jaw 29'. A second component 15" is inexpensive and disposable. It is extruded from aluminum to be custom machined to hold a particular work piece during machining. It has a dovetail element that slides laterally into a correspondingly shaped recess in the first component to form a secure dovetail joint. Threaded fasteners 26' compress the recess. This system is very practical for mounting a single work piece in a vise for machining. The component 15" is easily machined to the shape of the work piece so that it will be held securely in a vise. If there are a number of pieces of the same shape to be machined, they may be mounted and machined one at a time. After the job is completed, the component 15" may be discarded and replaced with a new component 15" at little cost. A number of small pieces may be clamped between the jaws after machining multiple recesses in component 15" to receive them individually. This reduces labor costs. However, if their dimensions in the clamping direction are not uniform, the longer ones will prevent the shorter ones from being held securely. This may increase costs by increasing inspection costs, requiring greater precision of the pieces, and scrapping of rejects.

Figure 6:
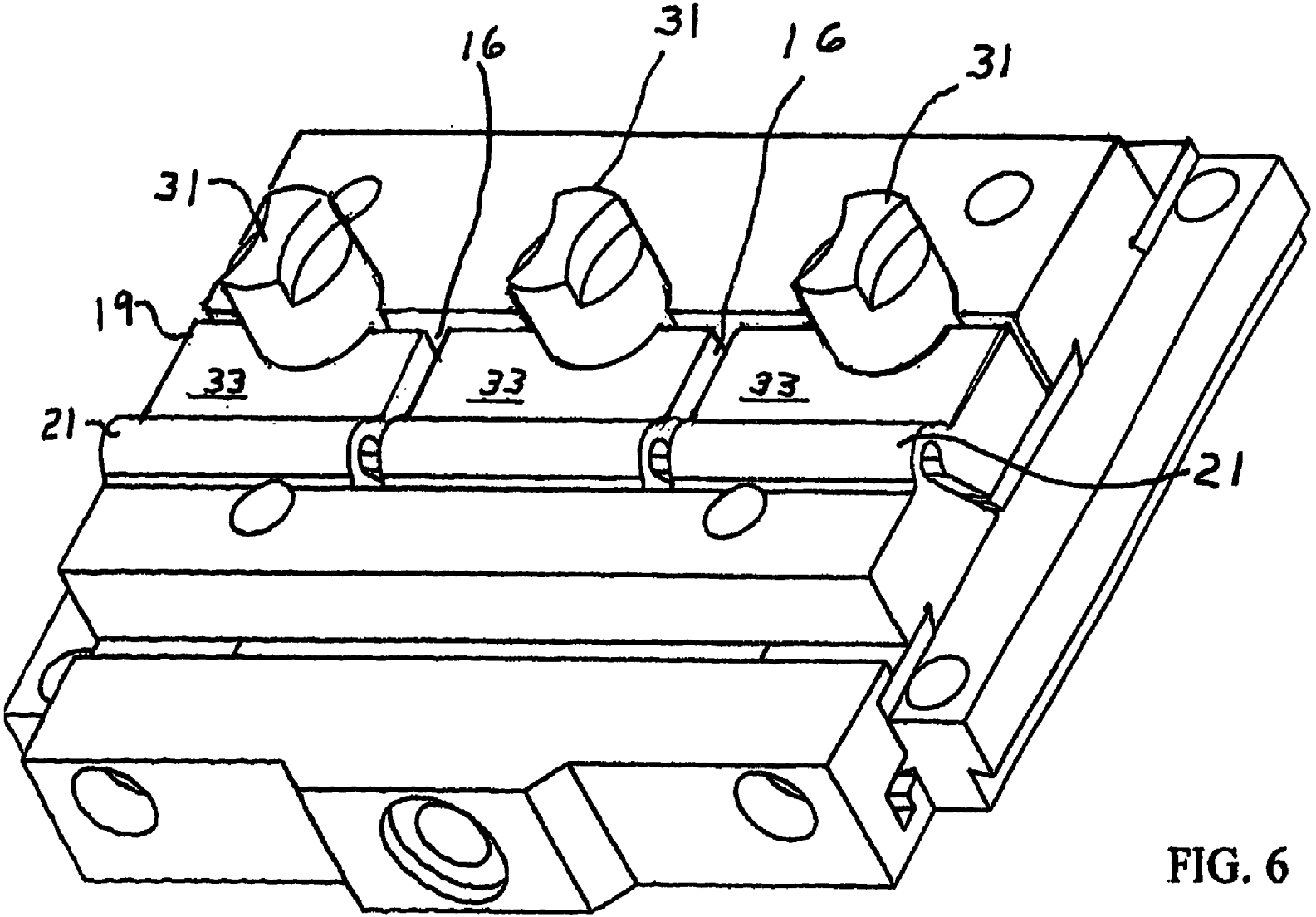
FIG. 6 is a perspective view of the assembly in a vise with many work pieces held.

Referring now to drawing FIGS. 2–6, the instant invention provides an elongate jaw assembly for vises that allows use of an inexpensive, easily machined plate for the jaw that could be replaced with minimum cost and effort that would allow securely holding a plurality of pieces despite minor dimensional variations. The assembly of the invention comprises a first reusable component 1 that is readily mounted on, and removed from, a machine vise jaw 29 by first threaded fasteners 7 through first apertures 5. The head 8 of bolt 7 is recessed below the surface. Component 1 has a top surface 2. A dovetail recess 10 in the top 2 has a slot 14 in the bottom 13 of the recess. The slot has front and rear side walls 3, and 4. The second component is securely connected to the first component by a joint such as a dovetail connector joint. The second component 15 has a base portion 17 with a dovetail element 18 extending downward from the base portion to provide the male portion of the joint and the first component has the recess, or female element of the joint to cooperate with the male element. The joint holds the two components together when the male element is slid laterally into the female recess. The joint is then tightened by threaded second fasteners 26. The second component has at least one machinable work piece engaging second portion 19 disposed along the length of the component for engaging the work piece. The second portion 19 is connected to a base portion 17 by an arcuate elastic third portion 21, providing a spaced-apart relation between the first and third portions with a space 22. The second portion 19 has a bottom portion 20 that slides along the top 2 of the first component 1 during the clamping action of the vise. The second component is constructed with a uniform cross section. It may thereby be produced in one piece by extrusion for economy of production, if desired When multiple work pieces 31 are to be mounted on the vise at one time, the elastic third portion and the machinable second portions 19 are cut into segments by slits 16, as best seen in FIG. 6. Each pair of segments 33 is then dimensioned to hold a single work piece 31. When multiple pieces are held in the vise, it may be that one or more of the pieces have a larger dimension than the others. When the jaws are closed, the larger pieces will hold the jaws too far apart to hold the smaller pieces securely. The operator will then close the jaws tighter. The segments holding the larger pieces will then elastically deform at the elastic portion thereby moving the face portion contacting the work piece far enough inward so that the smallest piece can be securely held by its segment. The flat bottom 20 of the second portion 19 slides along the top 2 of the first component during the clamping action. This structure defines the elevation of portion 19 relative to the vise during clamping. The third portion 21 is so constructed that its deformation is elastic. It will return to its original position when the vise is opened to receive another piece for machining. This apparatus enables a user to repeatedly and reproducibly mount a plurality of pieces in a vise and clamp them tightly enough for machining, even when there are slightly different dimensions in the pieces.

Figure 7:
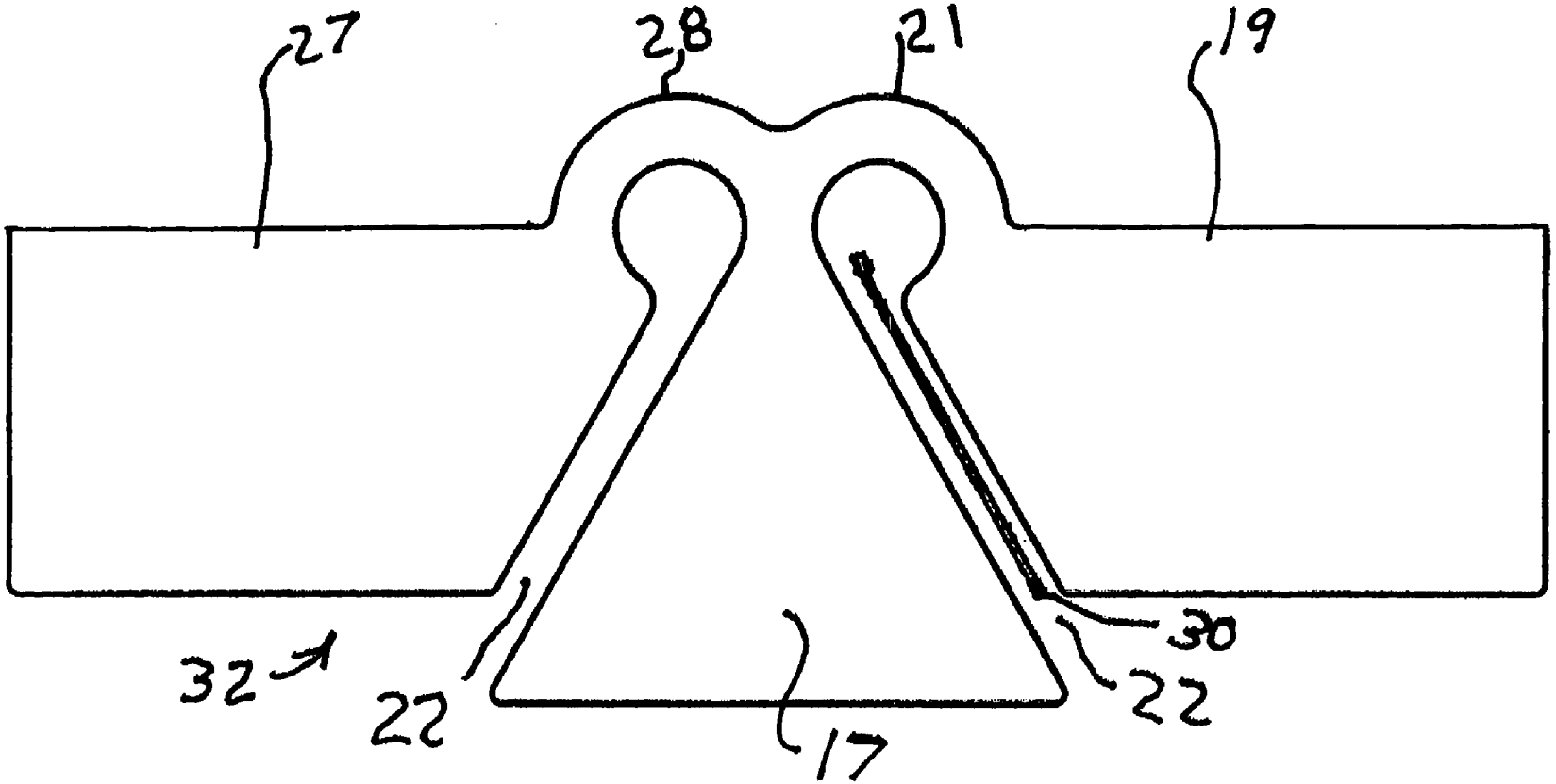
FIG. 7 is a side elevation view of an alternative embodiment of the invention.

Referring now to FIG. 7, another embodiment 32 of the second component is shown. It provides an additional work piece machinable fourth portion 27 held spaced apart from the base portion 17 by an elastic connector fifth portion 28, so that the component 32 may be used to hold parts on both sides of a central jaw of a vise. A resilient elastic strip 30 of a particular durometer may be introduced into the space 22 if desired to further control the elastic action.

Figure 8:
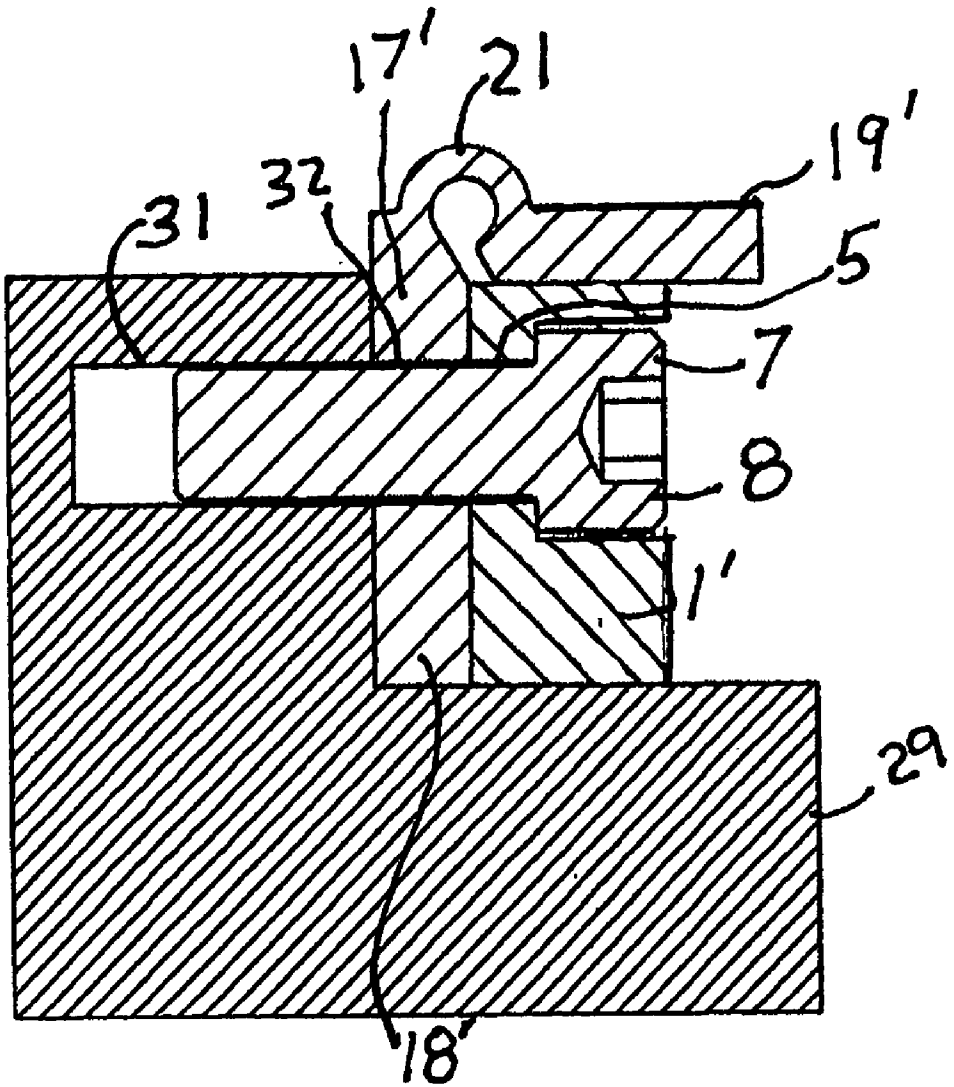
FIG. 8 is a sectional view of another embodiment of the invention mounted on a vise jaw.
Figure 9:
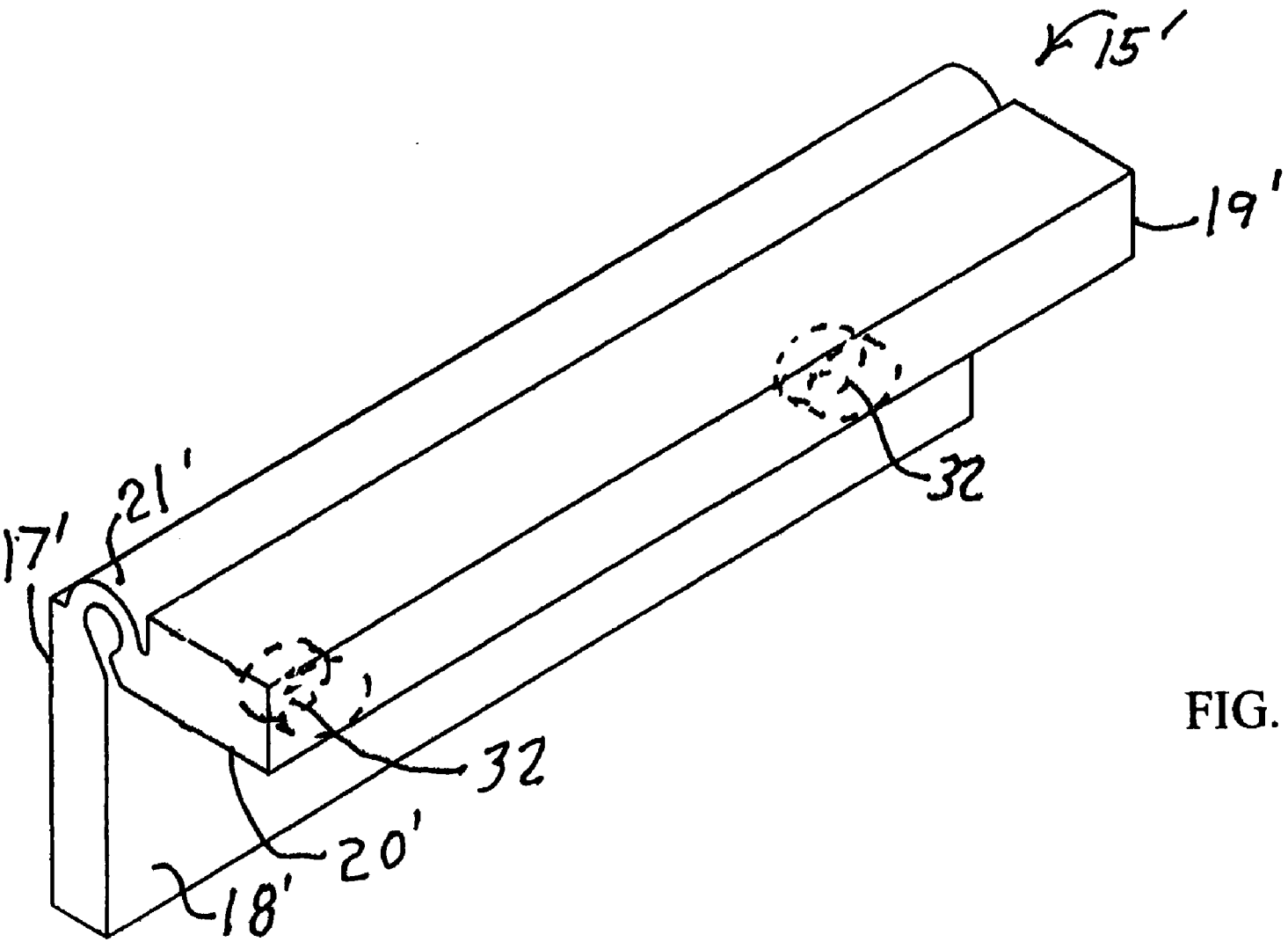
FIG. 9 is a perspective view of the machinable, disposable component of FIG. 8.
Figure 10:
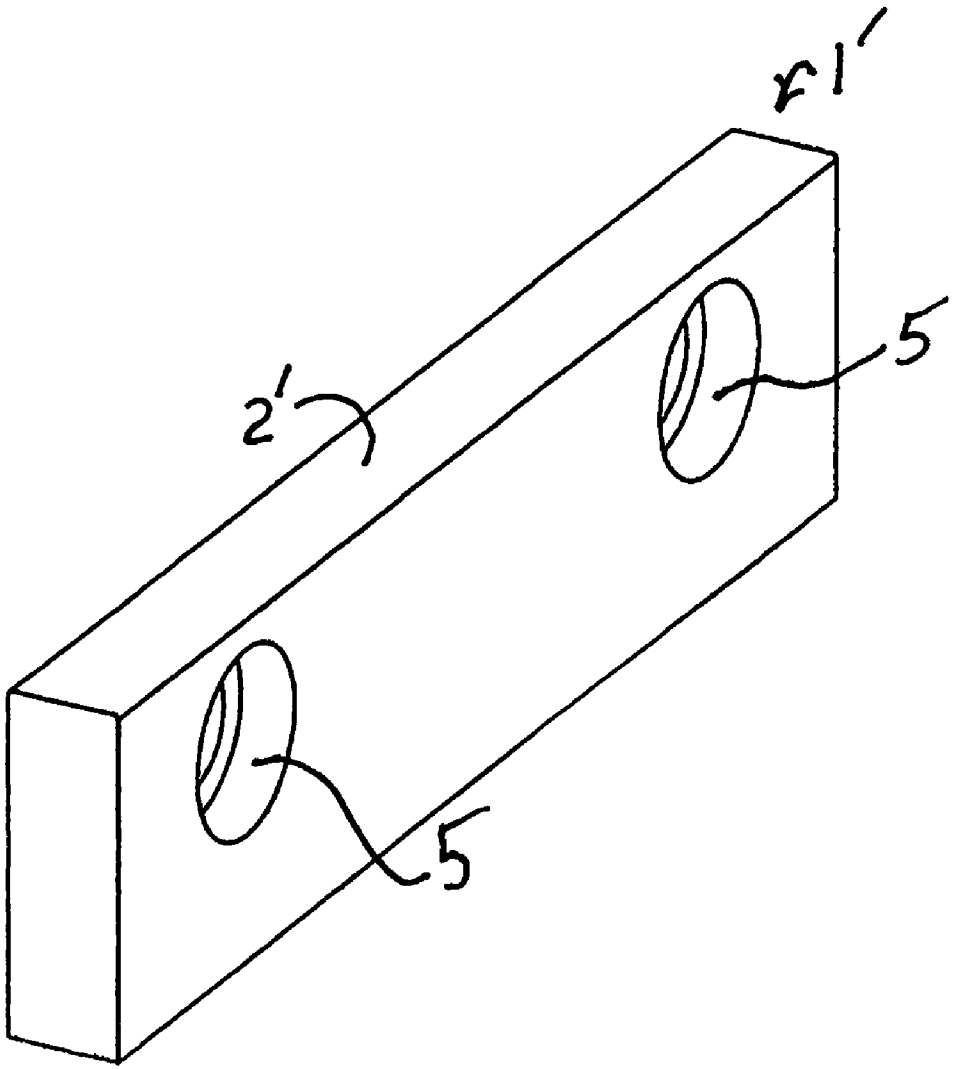
FIG. 10 is a perspective view of a reusable component of FIG. 8.

Referring now to FIGS. 8, 9, and 10, the instant invention provides a jaw assembly for vises that allows use of an inexpensive, easily machined plate for the jaw that could be replaced with minimum cost and effort that would allow securely holding a plurality of pieces despite minor dimensional variations. The assembly of the invention comprises a first reusable component 1' that is readily mounted on, and removed from, a machine vise jaw 29 by first threaded fasteners 7 through apertures 5, and into threaded holes 31 in the jaw 29. The head 8 of bolt 7 is recessed below the surface of 1'. Component 1' has a flat top surface 2'. The second component 15' comprises a base first portion 17'. A connector element 18' projects downwardly from the base first portion. Apertures 32 in connector element 18' receive the bolts 7 to clamp the component 15' securely between the component 1' and the jaw plate 29. A machinable, work piece holding second portion 19' is connected to the base portion 17' by an elastic third portion 21', providing a spaced-apart relation between the first and third portions with a space 22'. The second portion 19' has a bottom portion 20' that slides along the top 2' of the first component 1' during the clamping action of the vise. The second component is constructed from stock with a uniform cross section. It may thereby be produced in one piece by extrusion for economy of production, if desired. The apertures 32 may be oversize to ensure that the bottom 20' lies directly on the top 2' to thereby define the elevation of portion 19' above the vise during clamping and to limit motion of portion 19' to translation. The components 1' may be removable steel jaws that are routinely supplied with some vises.

Figure 11:
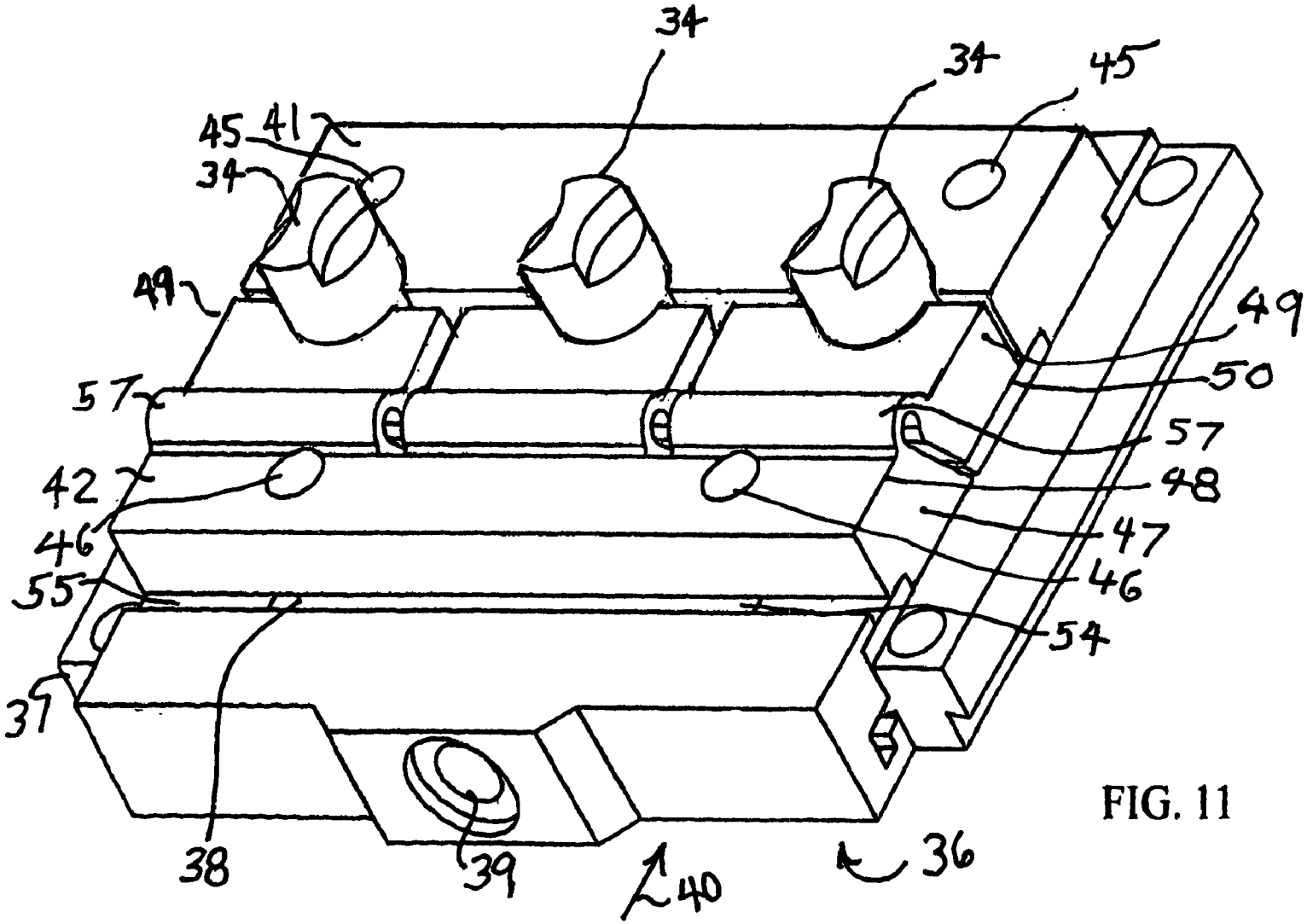
FIG. 11 is a perspective view of another embodiment of the invention.
Figure 12:
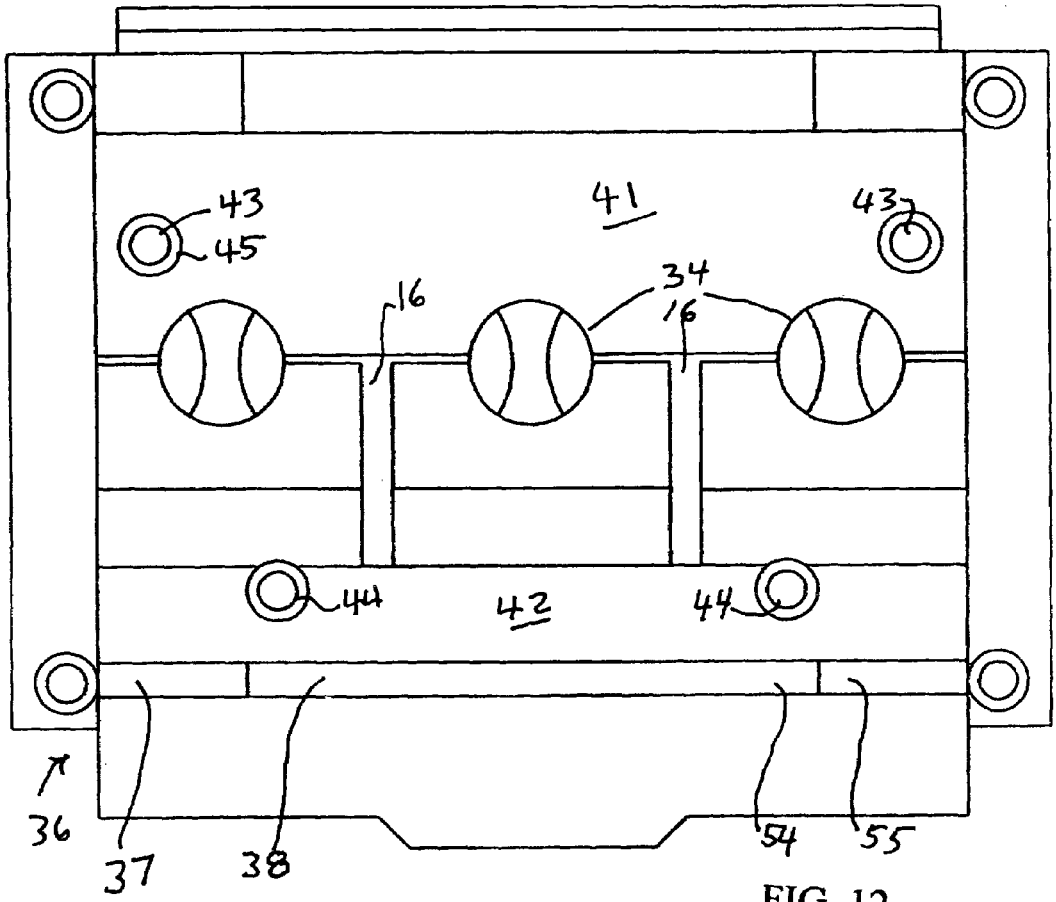
FIG. 12 is a top view of the embodiment of FIG. 11.
Figure 13:
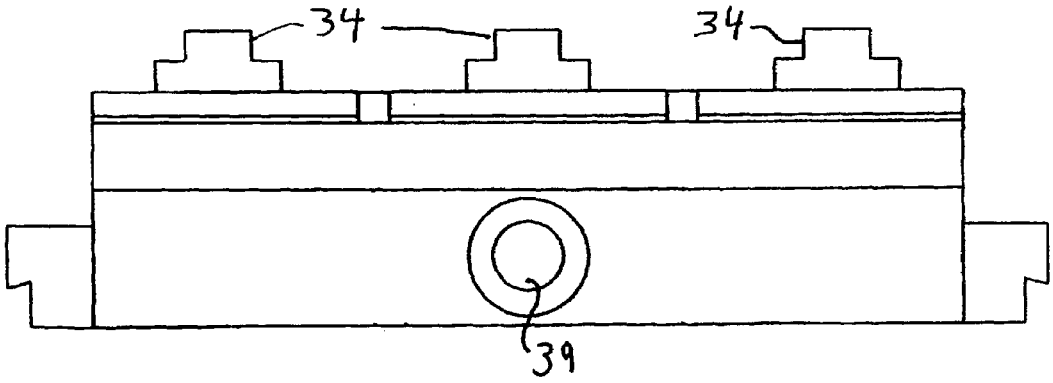
FIG. 13 is a front elevation view of the embodiment of FIG. 11.

Referring now to the embodiment of the invention shown in FIGS. 11–13, a vise 36 of the invention includes a stationary member 37 and a movable member 38 that slides in a first direction 40 in the stationary member. Screw drive 39 moves member 38 to clamp work pieces 34 between machinable elongate stationary jaw plate 41 and movable machinable resilient and segmentable elongate jaw plate 42. Stationary machinable jaw plate 41 is bolted by bolts 43 into threaded holes 45 in the stationary member 37. Movable resilient jaw plate 42 is bolted by bolts 44 into threaded holes 46 in the movable member 38. The top surface 54 of movable member 38 is coplanar with top surfaces 55 of stationary member 37. Jaw plate 42 has a base first portion 47 and a connector element 48 extending from the first portion. Holes 46 in connector element 48 receive bolts 44 for removably affixing the element to the movable member 38 of the vise. Work piece engaging elongate second portion 49 is machined as required to conform to the particular work piece configuration. An elastic connector third portion 57 connects the first and second portions in a spaced apart relation so that it can flex when great clamping forces are applied to the portion 49 engaging the work piece. Slits 16 enable each segment to flex individually. The second portion 49 has a flat bottom 50 that engages and slides on the coplanar surfaces 54 and 55. The structure ensures that the portion 49 is limited to translatory motion in the first direction. This enables reproducible elevation of the work pieces above the vise base.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An elongate vise jaw plate assembly for mounting on a face of a vise jaw of a vise that is adapted for translatory motion in a first direction, the assembly comprising:

a) a first component having:

i) a top, a front face, and a rear face;

ii) a plurality of first apertures extending in the first direction between the front and rear faces, the apertures constructed for receiving jaw-engaging first fasteners with their fastener heads being recessed below the front face when the rear face is held securely against the jaw face by the first fasteners when the first fasteners are received in threaded holes in the jaw face;

iii) a dovetail recess in the top, the recess having front and rear side walls and a bottom portion, the recess extending the full width of the first component in a direction transverse to the first direction; and iv) a slot extending downward from the bottom portion, the slot extending the full width of the recess;

b) a second component constructed of a readily machinable material with a uniform cross section, and having:

i) a base first portion;

ii) a dovetail connector element projecting from the first portion, the dovetail element constructed to mate securely with the recess in the first component;

iii) a work piece engaging second portion having a bottom portion for engaging the top of the first component;

iv) an elastic connector third portion connecting the first and second portions in a spaced apart relation, the third portion constructed to elastically flex when great clamping force is applied to the second portion when clamping a work piece in the vise, and to return to an original position when clamping force is removed; and c) a plurality of second apertures extending in a first direction between the front and rear faces of the slot of the first component, the second apertures being unthreaded in a portion between the front face and the slot, the second apertures constructed for receiving therein second fasteners for threadedly engaging a threaded portion between the slot and the rear face while the fastener heads are recessed below the front face for drawing the side walls together to contract the recess and hold the dovetail element securely within the recess.

2. The assembly of claim 1 in which the elastic connector third portion has an arcuate shape.

3. The assembly of claim 2 in which the material is aluminum alloy.

4. The assembly of claim 1 in which the material is aluminum alloy.

5. The assembly of claim 4 in which the second component further comprises:

a) a work piece engaging fourth portion having a bottom portion for engaging the top of the first component; and b) an elastic connector fifth portion connecting the first and fourth portions in a spaced apart relation, the fifth portion constructed to elastically flex when great clamping force is applied to the fourth portion when clamping a work piece in the vise, and to return to an original position when clamping force is removed.

6. The assembly of claim 5 in which the elastic connector third and fifth portions have an arcuate shape.

7. The assembly of claim 6 further comprising an elastic strip interposed between the second portion and the base portion and another elastic strip interposed between the fourth portion and the base portion of the second component.

8. The assembly of claim 1 further comprising an elastic strip interposed between the second portion and the base portion of the second component.

9. In a vise jaw plate assembly for mounting on a face of a vise jaw of a vise that is adapted for translatory motion in a first direction, with a first component having a top, a front face, and a rear face, a plurality of first apertures extending in the first direction between the front and rear faces, the apertures constructed for receiving jaw-engaging first fasteners with their fastener heads being recessed below the front face when the rear face is held against the jaw face by the first fasteners when the first fasteners are received in threaded holes in the jaw face, a dovetail recess in the top, the recess having front and rear side walls and a bottom portion, the recess extending the full width of the first component in a direction transverse to the first direction, and a slot extending downward from the bottom portion, the slot extending the full width of the recess, and a plurality of second apertures extending in a first direction between the front and rear faces of the slot of the first component, the second apertures being unthreaded in the portion between the front face and the slot, the second apertures constructed for receiving therein second fasteners for threadedly engaging the portion between the slot and the rear face while the fastener heads are recessed below the front face for drawing the side walls together to contract the recess and hold a dovetail element securely within the recess, the improvement comprising:

a) a second component constructed of a readily machinable material with a uniform cross section, and having:

i) a base first portion;

ii) a dovetail connector element projecting from the first portion, the dovetail element constructed to mate securely with the recess in the first component;

iii) a work piece engaging second portion having a bottom portion for engaging the top of the first component;

iv) an elastic connector third portion connecting the first and second portions in a spaced apart relation, the third portion constructed to elastically flex when great clamping force is applied to the second portion when clamping a work piece in the vise, and to return to an original position when clamping force is removed.

10. The assembly of claim 9 in which the elastic connector third portion has an arcuate shape.

11. The assembly of claim 10 further comprising means for clamping a plurality of individual work pieces securely in a single vise tightening by cutting through the second and third portions in the first direction as often as required so that the second and third portions are divided into individual segments for clamping each work piece individually.

12. The assembly of claim 9 in which the second component further comprises:

a) a work piece engaging fourth portion having a bottom portion for engaging the top of the first component; and b) an elastic connector fifth portion connecting the first and fourth portions in a spaced apart relation, the fifth portion constructed to elastically flex when great clamping force is applied to the fourth portion when clamping a work piece in the vise, and to return to an original position when clamping force is removed.

13. The assembly of claim 12 further comprising means for clamping a plurality of individual work pieces securely in a single vise tightening by cutting through the second, third, fourth, and fifth portions in the first direction as often as required so that the second, third, fourth, and fifth portions are divided into individual segments for clamping each work piece individually.

14. The assembly of claim 9 further comprising an elastic strip interposed between the second portion and the base portion of the second component.

15. In a vise jaw plate assembly for mounting on a member of a vise that is adapted for clamping by translatory motion in a first direction, the improvement comprising:

an elongate jaw plate constructed from a readily machinable material with a uniform cross section, and having:

i) a base first portion;

ii) a connector element extending from the first portion;

iii) means for removably affixing the connector element to the vise;

iv) a work piece engaging second portion having a bottom portion;

v) an elastic connector third portion connecting the first and second portions in a spaced apart relation, the third portion constructed to elastically flex when great clamping force is applied to the second portion when clamping a work piece in the vise, and to return to an original position when clamping force is removed, and vi) means for limiting the motion of the second portion to translatory motion in the first direction during the clamping.

16. The jaw plate of claim 15 in which the means for limiting the motion of the second portion includes providing a rigid surface fastened to an element of the vise upon which the flat bottom of the second portion is arranged to slide during clamping.

17. The jaw plate of claim 16 further comprising:

a) a work piece engaging fourth portion having a bottom portion;

b) an elastic connector fifth portion connecting the first and fourth portions in a spaced apart relation, the fifth portion constructed to elastically flex when great clamping force is applied to the fourth portion when clamping a work piece in the vise, and to return to an original position when clamping force is removed; and c) means for limiting the motion of the fourth portion to translatory motion in the first direction during the clamping process.

18. The jaw plate of claim 16 further comprising means for clamping a plurality of individual work pieces securely in a single vise tightening by cutting through the second and third portions in the first direction as required so that the second and third portions are divided into individual segments for clamping each work piece individually.

19. The jaw plate of claim 17 further comprising means for clamping a plurality of individual work pieces securely in a single vise tightening by cutting through the second, third, fourth, and fifth third, fourth, and fifth portions in the first direction as required so that the second, third, fourth, and fifth portions are divided into individual segments for clamping each work piece individually.

20. The jaw plate of claim 18 in which the third portion has an arcuate shape.

* * * * *